United States Patent [19]

Liu

[11] Patent Number: 4,553,766

[45] Date of Patent: Nov. 19, 1985

[54] ROCKING AND MOVING MIMIC HORSE

[76] Inventor: Chen-Chia Liu, No. 32 Ta Jen Kung Rd., Kaohsiung, Taiwan

[21] Appl. No.: 441,629

[22] Filed: Nov. 15, 1982

[51] Int. Cl.[4] ..... A63F 1/07

[52] U.S. Cl. ..... 280/1.182; 280/1.192

[58] Field of Search ..... 280/1.192, 1.191, 1.182, 280/1.165, 1.175

[56] References Cited

U.S. PATENT DOCUMENTS

| | | | |
|---|---|---|---|
| 1,376,132 | 4/1921 | Ballin | 280/1.192 |
| 1,556,090 | 10/1925 | Edwards | 280/1.192 |
| 1,684,250 | 9/1928 | Tegelberg | 280/1.192 |
| 2,127,056 | 8/1938 | Davis | 280/1.192 |
| 2,996,298 | 8/1961 | Grosse et al. | 280/1.192 |

*Primary Examiner*—Joseph F. Peters, Jr.
*Assistant Examiner*—Donn McGiehan
*Attorney, Agent, or Firm*—Holman & Stern

[57] ABSTRACT

A mimic horse which can be rocked to and fro and can be moved forward or backward like a tricycle at the same time comprises a simulated animal body mounted on a wheel supporting frame, a steering rod, a set of power mechanisms, and a set of direction changing mechanisms. The direction shift has three stages, forward, neutral and backward, which change the position of pawls of two ratchet mechanisms to make the pawls push the ratchets around for forward or backward motion, or to stay idle without touching the ratchets. The movement of the ratchets is transmitted to the shaft of the rear wheels, which are thereby driven. A child rides on the back of this mimic horse rocking to and fro, and can move the horse forward, backward or can stay stationary without going forward or backward.

5 Claims, 10 Drawing Figures

ROCKING AND MOVING MIMIC HORSE

BACKGROUND OF THE INVENTION

1. Field of the Invention

This invention relates to rocking horses used as toy playthings for children.

2. Description of the Prior Art

Presently, mimic horses for kids generally only rock to and fro on the spot without moving forward or backward and therefore are only equipped with a single function. As for tricycles, they can only run mainly forward and are unable to be rocked to and fro. Families like to have various playing things like tricycles, mimic horses, small trains, etc., for their young kids in order to satisfy their natural tendency, and it would become a monetary burden to some to buy numerous toys, in addition to the possible mess caused by numerous toys in their homes.

BRIEF SUMMARY OF THE INVENTION

In order to overcome the above disadvantages, the inventor has invented this rocking and moving mimic horse equipped both with an animal image and with a set of power mechanisms enabling it not only to rock but also to move forward or backward.

BRIEF DESCRIPTION OF DRAWINGS

In order that this invention can be clearly understood, an embodiment thereof will now be described by way of example with reference to the accompanying drawings wherein.

DESCRIPTION OF THE PREFERRED EMBODIMENT

This rocking and moving mimic horse consists of a simulated horse body 1, wheel supporting frame 2, steering rod assembly 3, a set of power mechanisms, and a set of direction changing mechanisms.

Figure 7B:
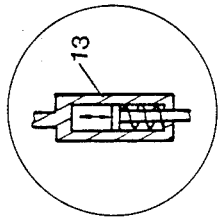
FIG. 7*b* is an enlarged view of the element within the inset of FIG. 7*a.*
Figure 7A:
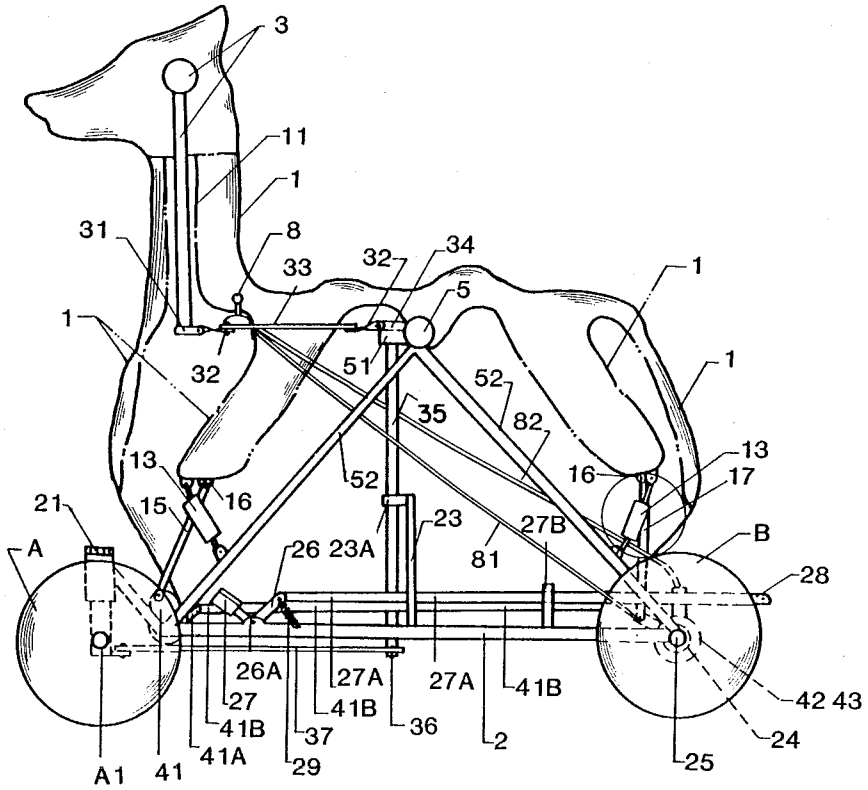
FIG. 7*a* is an elevational view of the entire mimic horse of this invention with part cut away to show the framework.

The body 1 can also be made to simulate other animals and it is separated into two parts, a head and a trunk. Its head can turn right or left by moving the T-shaped steering assembly rod 3, which is fixed inside the neck. In the center of the neck is a round hole 11, through which T-shaped steering rod 3 is placed. Inside the back is a horizontal bolster 5 supporting the trunk, as a pivot, enabling the horse body to tilt forward and backward, in other words, rock to and fro. Under both ends of horizontal bolster 5 are fixed supporting rods 52 on wheel supporting frame 2. The inside of the horse body 1 is made empty so as to give space for supporting frame 2, steering rod assembly 3, a set of power mechanisms, and various parts for transmitting movement. Inside the horse body 1 there are four springs 13 (FIG. 7*b*) at both sides of the front and rear in order to limit the tilting angle of horse body 1 and to give proper elasticity during its rocking. And there is also at the right of the front inside horse body 1, connecting plate 14, which is connected to movable motion rod 15, the other end of which is connected with eccentric disk 41. At the left inside horse body 1 is connecting plate 15, which unites with motion rod 17, the other end of which connects with rod 61 belonging to ratchet 43. At both front ends of wheel supporting frame 2 are coupling sockets 21, which are combined with wheel shafts A1 of two front wheels A so that front wheels A can be moved in any direction. Horizontal rod 22 is placed at about the middle of the side rods of wheel supporting frame 2; at a little to the right side of the center of horizontal rod 22 are two rings 22A used for attaching rod 22 to eccentric disk 41.

At the middle part of both side rods of wheel supporting frame 2 is set vertically U-shaped rod 23; at the center of U-shaped rod 23 is placed ring 23A; through ring 23A and through ring 51 is inserted vertical rod 35, which can be turned around (rotated); at both ends of side rods of wheel supporting frame 25 are fixed bearings 24 supporting wheel shaft (rear axle) 25, which has rear wheels B on both its ends. Ratchets 42, 43 are set between rear wheels on shaft 25. Steering rod 3 is a T-shaped rod set in the horse head with its horizontal part protruding out of the head so that a rider can catch hold of it and operate it to change the direction of this mimic horse. The vertical part of steering rod 3 goes down through the neck of horse body 1, is kept in place by means of round hole 11 and is able to turn around freely. The bottom end of steering rod 3 is connected with the center of horizontal rod 31, both ends of which are bent to form a U-shape. Both ends are connected with one end of connectors 32, and the other ends of connectors 32 are united with connecting rods 33; the other ends of connecting rods 33 are connected with both ends of horizontal rod 34. The function of connectors 32 is complete transmission of direction change while horse body 1 is rocking. Horizontal rod 34 is connected to vertical rod 35, with which another horizontal rod 36 is connected; vertical rod 35 is maintained in place by rings 51, 23A; both ends of horizontal rod 36 are united to crisscross connecting rods 37 whose front ends are pivotally connected with front wheel shafts A1. If steering rod 3 is turned to the right, horizontal rod 31 is turned accordingly, and in turn connectors 32 pull and push connecting rods 33. That is to say, right connecting rod 33 is pushed back and left connecting rod 33 is pulled forward; in turn, horizontal rod 34 is turned to the right for a certain angle, which makes vertical rod 35 turn accordingly. The movement of vertical rod 35 is transmitted to horizontal rod 36, whose ends pull and push the two front wheels A turning them to the right. Therefore, this mimic horse will go to the right. On the contrary, when steering rod 3 is turned to the left, the mimic horse will go to the left.

Figure 2:
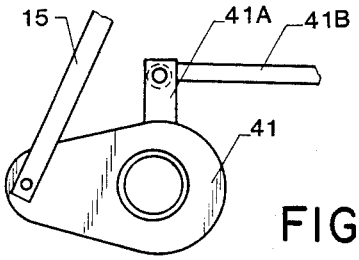
FIG. 2 is a side elevational view of the eccentric disc of this invention.
Figure 3A:
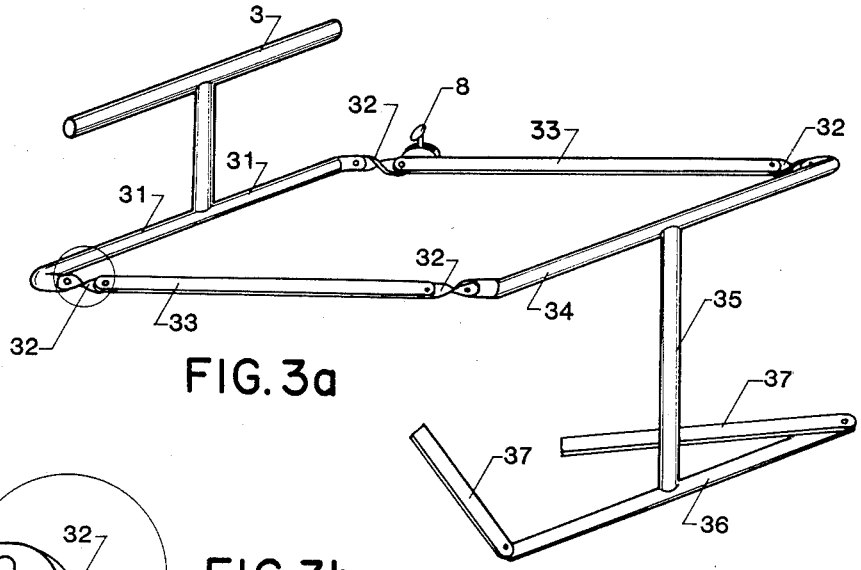
FIG. 3*a* is a perspective view of the steering rod assembly of this invention.
Figure 3B:
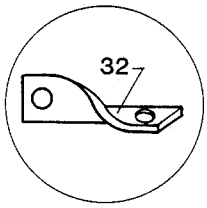
FIG. 3*b* is an enlarged view of the connecting link within the inset of FIG. 3*a;*
Figure 4A:
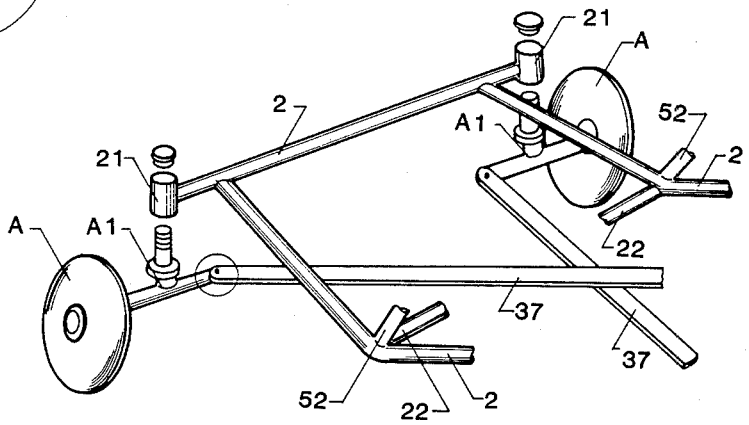
FIG. 4*a* is a perspective view of part of the wheel supporting frame of this invention.
Figure 4B:
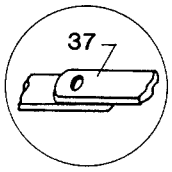
FIG. 4*b* is an enlarged view of the connection within the inset of FIG. 4*a;*

The set of power mechanisms includes eccentric disk 41, ratchets 42, 43, rods 61, 62, and pawls 71, 72 as main parts. As eccentric disk 41 is activated by motion rod 15, disk 41 turns downwardly (FIG. 2) when horse body 1 is tilted forward, and control rod 41A connected with eccentric disk 41 moves connecting rod 41B pivotally connected with control rod 41A. In turn, connecting rod 41B rocks rods 62 pivotally mounted on axle 25 and with which pawl 72 is combined. Pawl 72 engages ratchet 42 to rotate it by movement of motion rod 15 caused by tilting of horse body 1 which is transmitted to ratchet 42, which drives shaft (axle) 25 and rear wheels B, and this action moves the mimic horse forward or backward.

With the left part of wheel shaft 25 is attached another ratchet 43, which has adjacent its sides rods 61 pivotally mounted on axle 25 and combined with pawl 71; the source of motion power comes from motion rod 17, which is pushed by backward tilting of horse body 1 so that the movement is finally transmitted to ratchet 43, which also makes rear wheels B turn as ratchet 42 does.

Figure 1:
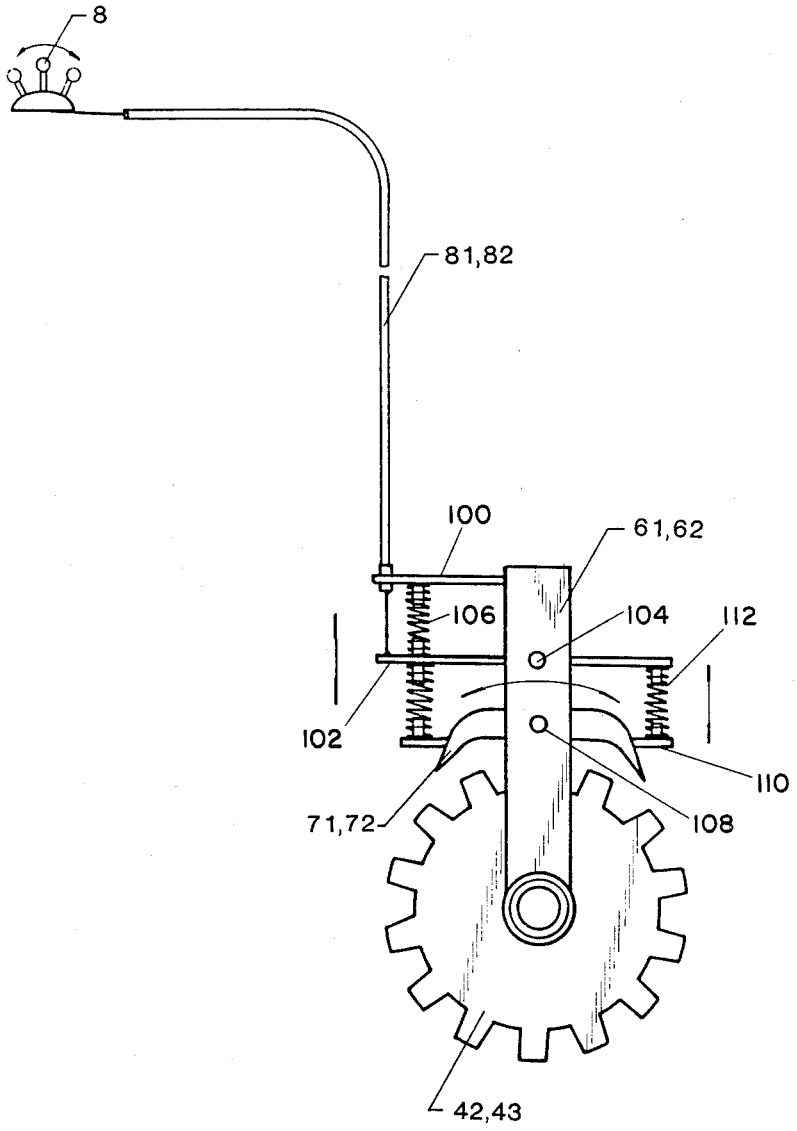
FIG. 1 is a side elevational view of the combined direction changing and power mechanisms of this invention.
Figure 5:
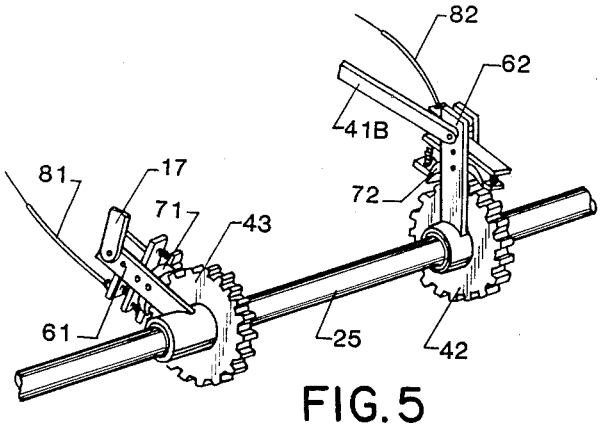
FIG. 5 is a perspective view of the ratchet assemblies of the power mechanism of this invention.
Figure 6:
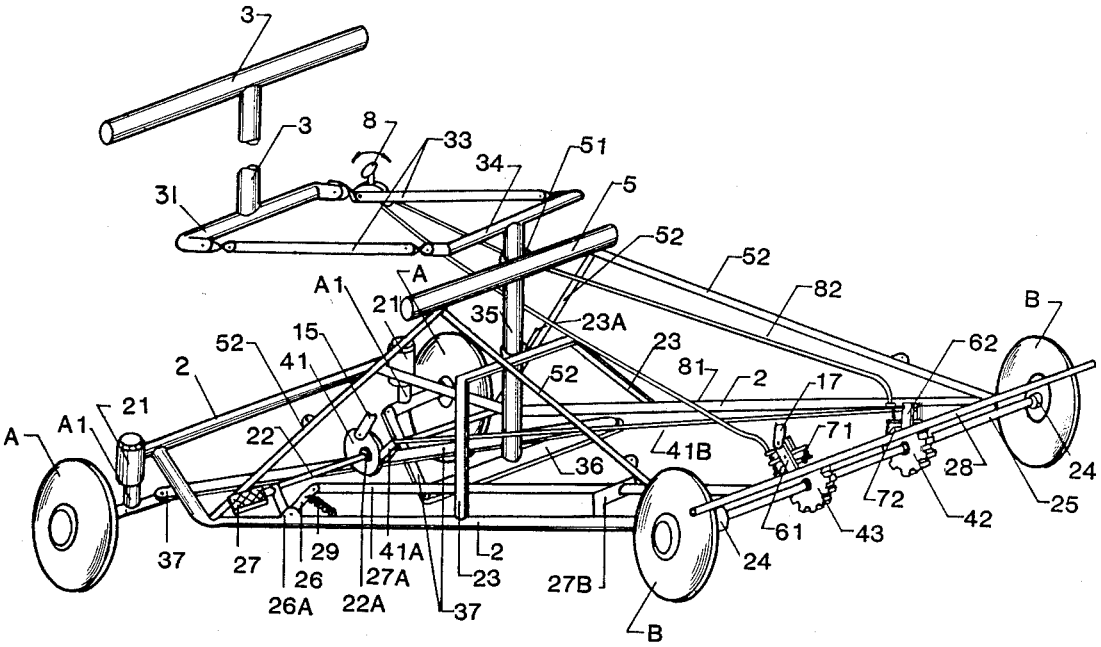
FIG. 6 is a perspective view of the entire structure of the mimic horse of this invention.

As FIGS. 1 and 5 show, rods 61, 62 are disposed on opposite sides of ratchets 42, 43 so that rods 61, 62, can cause pawls 71, 72 to move around ratchets 42, 43 by rotating to and fro on wheel shaft (axle) 25 caused by the motion of the horse body tilting backward and forward so that the horse is driven forward or backward.

FIGS. 1 and 5 also show that the selection in driving forward and backward by pawls 71, 72 is accomplished by a changing mechanism, which consists of direction control shaft lever 8 fixed on the front end of connecting rod 33, and wire control cables 81, 82. When direction shift lever 8 is pushed to the front, as FIG. 1 shows, the other or lower ends of wire ropes 81, 82 are separated to urge pawls 71, 72 to incline downwardly to the left, and this position makes ratchets 42, 43 turn counterclockwise for forward drive. If direction shift lever 8 is in the middle position, pawls 71, 72 are held away from engagement with the teeth of ratchets 42, 43, and the horse stays on the spot unable to go forward or backward, no matter how the horse body may be rocked. But, if direction shift lever 8 is pulled to the rear, the lower ends of wire cables 81, 82 are drawn together, making pawls 71, 72 incline downwardly to the right, which causes ratchets 42, 43 to turn clockwise for backward drive.

Each device that accomplishes this drive motion comprises a bracket 100 fixedly mounted at one end on rods 61, 62 and having fixed at its other end the lower end of outer cable 81, 82 of the associated coaxial cable. Lever 102 is pivotally mounted along its length to members 61, 62 at 104 and spring member 106 is mounted between members 101 and 102. The lower end of the inner cable of coaxial cable 81, 82 is mounted to the outer end of lever 102 so that relative movement between the coaxial cables produces relative movement between members 100 and 102. Pawls 71, 72 are pivotally mounted at 108 between members 61, 62, respectively, and have extensions 110 thereon the outer ends of which are engaged by spring 112 extending between them and lever 102 to resiliently urge them in predetermined spaced relationship.

There is a brake system for this mimic horse because it moves forward or backward. This system consists of V-shape plate 26, fixing piece 26A, brake pedal 27, connecting rod 27A and brake rod 28, V-shape plate 26 is pivotally mounted on wheel supporting frame 2 at fixing piece 26A, and one end of V-shape plate 26 is attached to brake pedal 27 sticking out of the horse body 1 to the left, while the other end of V-shape plate 26 is pivotally connected with connecting rod 27A supported by support plate 27B so that it is able to move freely back and forth. The other end of connecting rod 27A is connected with brake rod 28, which presses against the two rear wheels B when pulled forward by connecting rod 27A which is activated by pressing down brake pedal 27. In addition, there is spring 29 between wheel supporting frame 2 and V-shape plate 26, in order that brake rod 28 is released from engagement with rear wheels B when brake pedal 27 is released.

What is claimed is:

1. A rocking and moving mimic horse comprising:

a wheel supporting frame;

a simulated horse body pivotally mounted on said frame for forward and backward rocking movement;

a set of wheels rotatably mounted on said frame for forward, backward, and turning movement of the frame;

a steering device operatively mounted on said frame and operatively connected to said wheels to turn the wheels to steer the frame and horse body comprising, a steering handle, a first downwardly projecting steering rod connected to said handle, a first substantially horizontal rod connected to said steering rod, a second substantially horizontal rod spaced rearwardly from said first rod, substantially parallel steering links pivotally connected at their ends to the ends of said first and second rods, a second downwardly projecting steering rod connected to said second substantially horizontal rod, a third substantially horizontal rod connected to said second downwardly projecting steering rod, and a pair of crossed steering links each connected at one end to one end of said third substantially horizontal rod and at their other ends to respective ones of said wheels mounted on said frame for turning, said handle, steering rods, substantially horizontal rods and steering links being connected so that turning said handle steers the mimic horse when moving forward and backward;

at least one power drive mechanism operatively engageable between said set of wheels and said horse body so that when engaged rocking motion of said horse body drives said set of wheels to propel said frame and horse body forward and backward; and a direction control device operatively engageable with said at least one power drive mechanism to selectively shift said mechanism between forward, backward and neutral non-engaged positions.

2. A rocking and moving mimic horse as claimed in claim 1 wherein:

said set of wheels comprises two rear wheels and a rear drive axle fixedly connected at each end to one of said rear wheels; and said at least one power drive mechanism comprises, a ratchet wheel fixedly mounted on said rear drive axle and a pawl means operatively engageable with said ratchet wheel to rotate said ratchet wheel in both directions about the axis of rotation of said axle, a drive disc rotatably mounted on said frame, a first drive link pivotally connected at one end to said disc eccentrically with respect to the axis of rotation of said didsc and at its other end to said horse body, a second drive link pivotally connected at one end to said disc eccentrically with respect to the axis of rotation of said disc and at the other end to said pawl means, so that rocking motion of said horse body causes rotation of said drive disc which operates said pawl means to thereby rotate said ratchet wheel.

3. A rocking and moving mimic horse as claimed in claim 2 wherein:

said first drive link is connected adjacent the front of said horse body; and said at least one power drive mechanism further comprises a second ratchet wheel fixedly mounted on said rear drive axle, second pawl means operatively engageable with said second ratchet wheel to rotate said second ratchet wheel in both directions about the axis of rotation of said axle, and a rear drive link connected at one end adjacent the rear of said horse body and at the other end to said second pawl means, so that rocking motion of said horse body operates said second pawl means to thereby rotate said second ratchet wheel.

4. A rocking and moving mimic horse as claimed in claim 3 wherein said pawls and ratchet wheels are cooperatively arranged so that forward rocking motion of said horse body propels said horse body through said first ratchet wheel and backward rocking motion of said horse body propels said horse body through said second ratchet wheel.

5. A rocking and moving mimic horse comprising:

a wheel supporting frame;

a simulated horse body pivotally mounted on said frame for forward and backward rocking movement;

a set of wheels rotatably mounted on said frame for forward, backward, and turning movement of the frame comprising, two rear wheels and a rear axle fixedly connected at each end to one of said rear wheels;

a steering device operatively mounted on said frame and operatively connected to said wheels to turn the wheels to steer the frame and horse body;

at least one power drive mechanism operatively engageable between said set of wheels and said horse body so that when engaged rocking motion of said horse body drives said set of wheels to propel said frame and horse body forward and backward comprising, a ratchet wheel fixedly mounted on said rear drive axle and a pawl means operatively engageable with said ratchet wheel to rotate said ratchet wheel in both directions about the axis of rotation of said axle, a drive disc rotatably mounted on said frame, a first drive link pivotally connected at one end to said disc eccentrically with respect to the axis of rotation of said disc and at its other end to said horse body, a second drive link pivotally connected at one end to said disc eccentrically with respect to the axis of rotation of said disc and at the other end to said pawl means, so that rocking motion of said horse body causes rotation of said drive disc which operates said pawl means to thereby rotate said ratchet wheel; and a direction control device operatively engageable with said at least one power drive mechanism to selectively shift said mechanism between forward, backward and neutral non-engaged positions comprising, a shift lever mounted on the horse body and selectively movable between the three positions of neutral, forward and backward, a coaxial cable comprising an outer cable attached at one end to said horse body adjacent said shift lever and at the other end to said pawl means, and an inner cable movable longitudinally with respect to said outer cable connected at one end to said shift lever and at the other end to said pawl means, so that when said shift lever is in the neutral position said pawl means is disengaged from said ratchet wheel, when said shift lever is in the forward position said inner cable moves said pawl means into engagement with said ratchet wheel for forward movement, and when said shift lever is in the backward position said inner cable moves said pawl means into engagement with said ratchet wheel for backward movement.

* * * * *